US005630202A

United States Patent [19]

Bergendahl

[11] Patent Number: 5,630,202

[45] Date of Patent: May 13, 1997

[54] METHOD FOR MAKING SPONGE IRON BRIQUETTES FROM FINE ORE

[75] Inventor: Hans G. Bergendahl, Bochum, Germany

[73] Assignee: Maschinenfabrik Koppern GmbH & Co. KG, Germany

[21] Appl. No.: 446,707

[22] PCT Filed: Sep. 30, 1993

[86] PCT No.: PCT/EP93/02681

§ 371 Date: Jul. 7, 1995

§ 102(e) Date: Jul. 7, 1995

[87] PCT Pub. No.: WO95/09079

PCT Pub. Date: Apr. 6, 1995

[51] Int. Cl.[6] ..... B22F 1/00

[52] U.S. Cl. ..... 419/69; 419/66; 75/755; 75/758; 75/759

[58] Field of Search ..... 419/33, 31, 66, 419/69; 75/436, 751, 755, 758, 759; 425/579

[56] References Cited

U.S. PATENT DOCUMENTS 2,799,573 7/1957 Barnett et al. .
3,627,288 12/1971 MacDonald .
3,647,417 3/1972 Wetzel et al. .

*Primary Examiner*—Charles T. Jordan
*Assistant Examiner*—Anthony R. Chi
*Attorney, Agent, or Firm*—Venable, Baetjer, Howard & Civiletti, LLP

[57] ABSTRACT

The present invention relates to a method for making sponge iron briquettes from fine ore with a maximum grain size of less than 2 mm, preferably less than 0.5 mm, wherein hot fine ore is fed to a roller press and is briquetted by the roller press to form sponge iron briquettes. Apart from briquettes, fine ore which is compacted in the spaces of briquette pockets of the roller press, as well as fines in dust form are produced during briquetting. These components are designated as returns and separated from the sponge iron briquettes. The returns are then fed to the fine ferrous ore prior to briquetting. The processing of fine ore has so far entailed great problems in the technical field. The invention suggests that the returns be directly fed to a conveyor system after having been separated from the sponge iron briquettes and that the returns which are still hot be fed by the conveyor system substantially evenly and continuously to the hot fine ore to be still briquetted. The mean particle size of fine ore is here smaller than the mean grain size of the returns. This coarsens the briquetting material, resulting in a selective improvement of the briquetting operation.

28 Claims, 4 Drawing Sheets

METHOD FOR MAKING SPONGE IRON BRIQUETTES FROM FINE ORE

BACKGROUND OF THE INVENTION

The present invention relates to a method for making sponge iron briquettes from fine ore with a maximum grain size of less than 2 mm, preferably less than 0.5 mm, wherein hot fine ore is fed to a roller press and briquetted by opposite briquette pockets of the roller press to form sponge iron briquettes and wherein during briquetting fine ore which is compacted by one of the separating webs between the briquette pockets, and fines in the form of dust are produced, the materials being separated as returns from the iron sponge briquettes and fed to the fine ore prior to briquetting, the mean grain size of the fine ore being smaller than the mean particle size of the returns.

In the prior art fine ore has normally been formed into pellets prior to hot briquetting. During briquetting sponge iron briquettes and returns are obtained, the returns being again fed to the pellets above the roller press.

Moreover, a single installation has become known in the prior art for directly pressing fine ore into its resultant particulate form. In this method the returns are collected and then fed to the fine ore prior to briquetting. This method, however, has not turned out to be very successful in practice and has not been accepted.

SUMMARY OF THE INVENTION

It is therefore the object of the present invention to improve a method for making sponge iron briquettes from fine ore in such a manner that the briquetting operation can be performed substantially without any trouble.

The object is attained according to the invention in that the returns are fed to a conveyor system after having been separated from the sponge iron briquettes and the returns which are still hot are fed by the conveyor system substantially evenly and continuously to the hot fine ore to be still briquetted.

Although it is known that returns are continuously fed during the briquetting of pellets and/or lump ore, this is a pure recycling measure which has no effect on the processing of the pelletized fine ore.

In comparison therewith, the invention has the advantage when particulate fine ores are processed that the flow of returns fed into the fine ore has a substantially uniform temperature and provides a uniform quantitative portion. The fine ore is then evenly coarsened by the continuously fed returns, which is conducive to an improved briquetting capacity. The pelletizing step which is normally considered to be necessary before the processing of the fine ore can entirely be dispensed with due to the present invention, since the characteristics of the fine ore can be influenced through the uninterrupted supply of returns. Moreover, the returns can respectively be returned at a temperature which can be chosen within a specific temperature range and depends on the speed of the transportation system. This avoids, in particular, thermal variations within the material to be processed, such variations possibly leading to an over-load on the roller presses. Hence, the service lives of the roller press are considerably increased, which in the final analysis reduces costs.

It is also advantageous when the sponge iron briquettes and the returns fall into a vibration drum or a rotation drum after briquetting for separating returns and sponge iron briquettes substantially entirely. Such a procedure is especially of advantage when the sponge iron briquettes are pressed with fixed briquette rolls which permit a relatively thin briquette seam, whereby the briquettes and the returns can be separated from one another by a relatively simple vibration drum or rotation drum. Furthermore, it is advantageous when the sponge iron briquettes and the returns are conveyed from the vibration drum or rotation drum to a vibrating screen which separates sponge iron briquettes and returns from one another. After the sponge iron briquettes and the returns have been separated from one another by the vibration drum or rotation drum, it is relatively easy owing to a simple vibrating screen to separate the two parts from one another.

The fine ore can be processed with the roller press in an especially favorable manner as to the procedure when the fine ore and returns are fed to a screw hopper arranged above the briquetting rolls, whose screw presses the mixed fine ore and returns into the nip of the briquetting rolls. On the one hand, this step has the advantage that the mixed material is once again heated by the prepressing operation with the screw, and on the other hand such a screw hopper makes it possible due to the movement of the mixed material to deoxidize and degasify the fine ore. This is of importance insofar as the fine ore is greatly loosened or even fluidized on account of its transportation. Continuously fed and relatively hot returns help to deoxidize the fine ore.

In another step the hot sponge iron briquettes can be fed to a briquette cooler after having been separated from the returns. To achieve a cooling of the sponge iron briquettes which is as rapid as possible, the briquettes can be cooled in a water bath in the briquette cooler. It has been found that reoxidation which is to be prevented by the cooling process does not differ substantially with respect to cooling in a water bath or with respect to cooling in air.

The returns which are separated by the screen has preferably a maximum grain size of about 15 mm. This limit guarantees that excessively coarse returns have no undesired effect on the briquetting operation.

In another form of the method the fine ore and returns can be pressed by the roller press such that sponge iron briquette strip pieces are at least obtained. The compaction of sponge iron into briquette strips is generally only known in the processing of lump ore and/or pellets. To this end the roller press has a loose roll and a fixed roll so that the nip can adapt to the amount of material supplied. Since the fine ore has a great flowing capacity, it is possible for the first time thanks to the suggested invention that the fine ore is made manageable for compaction as a briquette strip thanks to the continuously fed returns which are in their hot state. This has the additional advantage that such a kind of pressing guarantees a longer service life of the roller presses. The briquette strip is preferably divided by a briquette strip divider into individual sponge iron briquettes and returns. The sponge iron briquettes and returns subsequently fall onto the vibrating screen.

Advantageous preconditions for briquetting the fine ore are created in that prior to briquetting the fine ore has a temperature of substantially 650° C. to 830° C. Moreover, it is advantageous when the returns have a temperature of substantially more than 300° C. when being supplied into the fine ore. Such a temperature can readily be observed in a hot-briquetting system with a continuous conveyor.

To prevent a premature reoxidation of the sponge iron or the sponge iron briquettes, the briquetting process as well as the separation and conveyance of the returns are substantially performed in an inert gas atmosphere.

Furthermore, protection is sought for a hot-briquetting system for making sponge iron briquettes from fine ore, especially according to a method according to any one of claims 1 to 12. The hot-briquetting system comprises a roller press including a pair of rolls provided with molding pockets, a separating device arranged below the roller press for separating sponge iron briquettes and returns and a conveyor system for conveying the returns from the separating device to a hopper arranged above the roller press, in which the returns are mixed with hot fine ore. The hot-briquetting system is characterized in that the conveyor system comprises a continuous conveyor for substantially continuously and evenly returning the returns in a substantially hot state.

Such a system for processing fine ore is not known in the prior art and offers the above-mentioned advantages.

The hopper has preferably arranged thereon an upwardly directed downpipe for feeding the returns, the upper end of said pipe being assigned to a continuous conveyor, preferably a bucket conveyor, which conveys the returns upwardly and discharges the same into the upper end. Such a design permits a relatively rapid and constructionally simple transportation mechanism for the returns.

Furthermore, it is advantageous when the hopper is a screw hopper whose prepress screw is arranged substantially at the lower end of the screw hopper and above the nip of the pair of rolls for pressing mixed fine ore and returns into the nip. Screw hoppers of this type have already proved to be successful in feeding particulate starting material into a nip.

In a preferred embodiment the pair of rolls includes a loose roll and a fixed roll, the loose roll correspondingly adapting to the amount of material supplied and the thickness of the briquette seam being adjustable for preferably producing a briquette strip. Such a design of the roller press has so far not been known in the processing of fine ore. It has the great advantage that the roller press has a considerably longer service life. A briquette strip divider is here advantageously arranged below the pair of rolls as part of the separating device for dividing the briquette strip into individual briquettes and returns.

In another embodiment the pair of rolls comprises two rigid fixed rolls for making briquettes with a briquette seam of a relatively small thickness. This type of roller press has proved to be very successful in the case of particulate starting material. The briquettes are predominantly discharged from the roller press individually or as briquette strip pieces whose briquettes, however, can very easily be separated from one another. In this type of design the briquettes have an especially uniform shape. A vibration drum or rotation drum is advantageously arranged below the roller press as part of the separating device for separating briquettes and returns from each other, the briquettes and the returns falling thereinto after the briquetting operation. The vibration drum or rotation drum is fully adequate for isolating the briquettes and for separating briquettes and returns from one another.

The vibration drum or rotation drum can also be used as a conveyor means when the axis of the vibration drum or rotation drum is slightly inclined relative to the horizontal. The briquettes and returns are then conveyed in the direction of inclination.

The separating device may also have assigned thereto a screen for separating briquettes and returns, the screen having preferably a mesh width of from 8 mm to 15 mm. A decision can be made with the help of this arrangement and by way of the mesh width of the screen as to where the line should be drawn between returns and briquettes.

The screen can also be used as a conveyor means if designed as a slightly inclined vibrating screen which conveys the sponge iron briquettes into a briquette chute extending from a discharge end of the screen downwards. The shaking movement of the vibrating screen ensures at the same time that briquettes and returns are separated from one another substantially entirely.

Furthermore, a vibrating surface can be arranged below the screen for receiving and directly transporting the returns, the vibrating surface conveying the returns into a returns chute which extends from a discharge end of the vibrating surface downwards and is assigned at its lower end to a lower portion of the continuous conveyor for discharging the returns. Hence, the returns are passed in the most rapid way from the screen to the continuous conveyor. An excessively great loss of heat is prevented owing to the rapid transportation of the returns. The lower end of the briquette chute advantageously ends in a briquette cooler. The briquette cooler takes care of the necessary cooling of the briquettes, so that the latter do not disadvantageously reoxidize to an excessive extent. It may here be especially advantageous when the briquette cooler is formed as a vibration cooler which cools with a water bath and which has a water inlet and outlet as well as a discharge location for the briquettes. A rapid cooling of the sponge iron briquettes is accomplished with the water bath on the one hand and the briquettes are simultaneously discharged by the vibration cooler for further transportation on the other hand.

The briquette cooler has preferably assigned thereto a heat exchanger which is connected to the water inlet and outlet for recooling the cooling water. Considerable amounts of cooling water can be saved thanks to this cooling system, which is of particular importance in countries with a shortage of water.

To prevent the reoxidation of the sponge iron briquettes also during the processing operation to a considerable extent, the roller press, the separating device, the briquette cooler and the conveyor system are surrounded by a gastight housing which has a gas connection for introducing preferably inert gases. The hopper, too, may have a connection for introducing inert gases, as well as a ventilating valve. The ventilating valve serves to discharge gas inclusions entrapped in the fine ore pores.

BRIEF DESCRIPTION OF THE DRAWINGS

Embodiments of the present invention will now be described in more detail with reference to a drawing, in which.

DETAILED DESCRIPTION OF THE INVENTION

Figure 1:
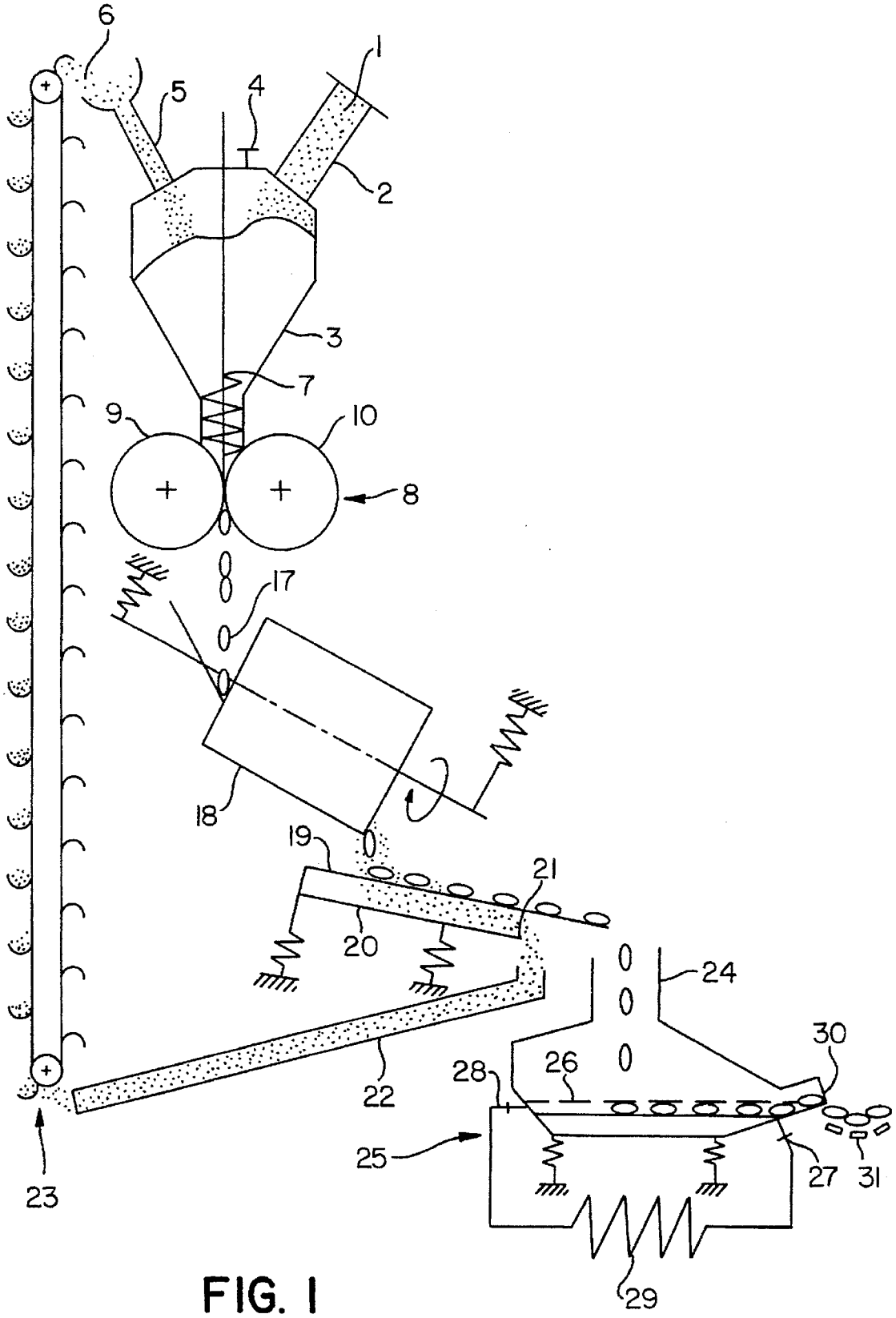
FIG. 1 is a diagrammatic view of a first embodiment of the present invention.

A first embodiment of the method of the invention and an embodiment of an apparatus for performing said method will now be explained in the following text, in particular, with reference to FIG. 1. A particulate sponge iron 1 which has been processed in a fluidized bed and is supplied in reduced form and in a hot state to the hot-briquetting system serves as the starting product for the present method. The grain size of the fine ore 1 is here 2 mm at the most, most of the fine ore having, however, a size of less than 0.5 mm. The temperature of the fine ore 1 is substantially between 650° C. and 830° C. The fine ore 1 has a bulk weight of about 2.3 g/cm$^3$ and is fed to the hot-briquetting system via a supply nozzle 2 which is arranged on an upper end portion of a screw hopper 3. The fine ore 1 is loosened due to transportation to a very great extent, so that a fluidization may even take place. As a consequence, screw hopper 3 is not fully filled with bulk material, so that gas inclusions in the fine ore 1 can escape upwards and can be discharged via a ventilating valve 4. Furthermore, a downpipe 5 is provided on the upper end portion of the screw hopper 3 for supplying returns 6 into the screw hopper 3. The returns 6 are composed of compacted fine ore 1 having a grain size of less than 15 mm, preferably less than 0.5 mm.

Furthermore, the screw hopper 3 has arranged therein a prepress screw 7 which presses mixed returns 6 and fine ore 1 into the nip of a roller press 8. The screw shaft is driven via a hydraulic drive (not shown) which has a torque that is high in case of a clamping of screw 7 and is capable of flexibly adapting to all kinds of variations. The screw hopper 3 is made of a highly refractory steel and is surrounded with an insulation (not shown) for protection against heat radiation. The roller press 8 has a first press roll 9 and a second press roll 10.

Figure 3:
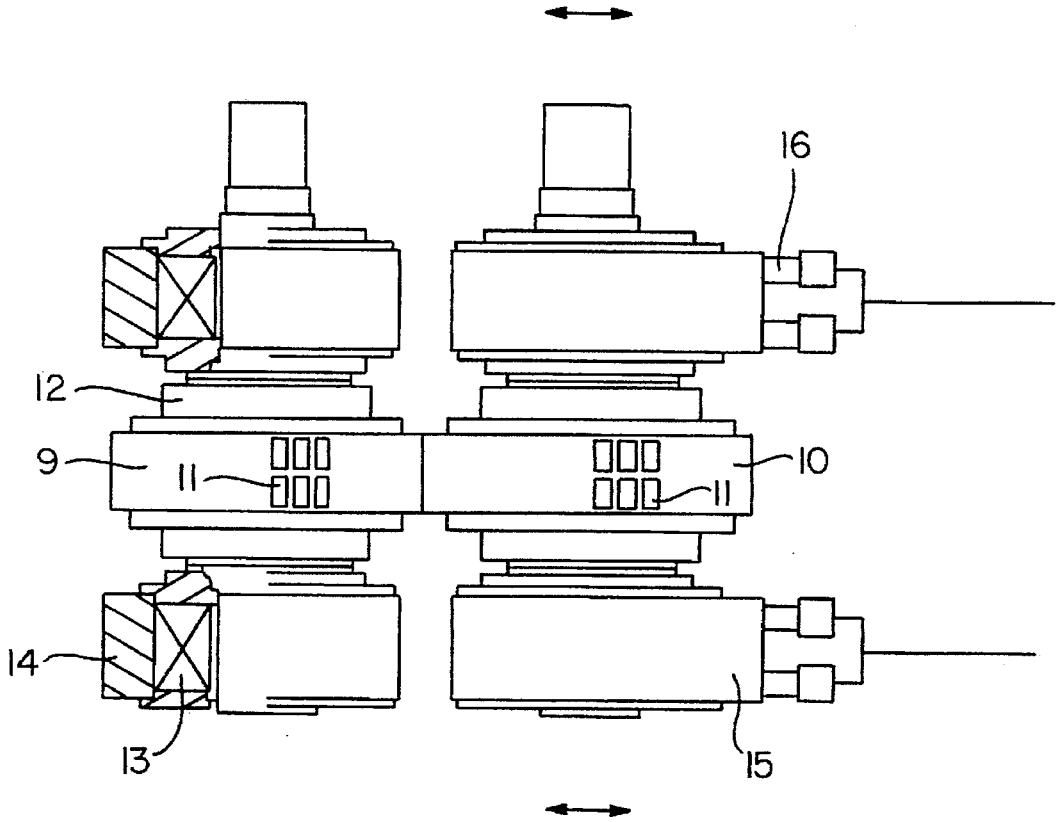
FIG. 3 is a diagrammatic view of a pair of rolls of a briquette roller press.

As can especially be seen in FIG. 3, the rolls are equipped with molding tools of segments or rings provided with briquette pockets 11. A roller body 12 on which the molding tools are mounted is supported in preferably self-aligning roller bearings 13 and provided with a corresponding cooling means (not shown). The press roll 9 is designed in this embodiment as a fixed roll, so that the bearing housing 14 is immovably arranged. By contrast, the second press roll 10 has a movable bearing housing 15, whereby the nip between the first and second press rolls 9 and 10 can be adjusted. The necessary displacement path and the necessary contact pressure of the two press rolls 9 and 10 are obtained through hydraulic cylinders 16 which act on the displaceable bearing housing 15.

In the embodiment shown in FIG. 1, the pressure in the hydraulic cylinders 16 is however set such that the press roll 10 is also a fixed roll. In such a case the hydraulic pressure passes via bearing housings 14 and 15 to spacers (not shown). Pressure cells are positioned in the spacers between bearing blocks. These measure, first of all, the full pressure without material. The pressure cells are partly relieved by introducting mixed fine ore 1 and returns 6. Such a signal change can then be used for controlling the screw speed.

Such a control has the advantage that material is pressed by the roller press 8 into sponge iron briquettes which have a relatively small briquette seam thickness, whereby the briquettes 17 are already isolated substantially immediately after the briquetting process or can be isolated relatively easily due to this small briquette seam thickness. As can be seen in FIG. 1, briquettes 17 or briquette strip pieces fall into a funnel-shaped introduction of a vibration drum 18 or rotation drum which can rotate about its own axis depending on the type and can perform a shaking movement. Since rolls 9 and 10 of roller press 8 are always provided with a certain nip, material which is then discharged as fragments from the roller press 8 and also introduced into the vibration drum 18 or rotation drum is also pressed by the web portions between the briquette pockets 11. The compacted fine ore fragments and possible fines are designated as returns 6 because they are later returned to the process.

Returns 6 and briquettes 17 are separated from one another substantially completely by the vibration drum 18 or rotation drum. A slight grinding operation is also performed due to the possibly simultaneous rotational movement, whereby the returns are partly comminuted. The vibration drum 18 or rotation drum is slightly inclined relative to the horizontal, so that returns 6 and briquettes 17 are further transported in the direction of inclination.

At the end of the vibration drum 18 or rotation drum returns 6 and briquettes 17 then fall onto a vibrating screen 19 which is preferably provided with a mesh width of 8 mm to 15 mm. All of the return pieces below a specific size fall through the screen 19 due to the shaking motion of the vibrating screen 19, which is also slightly inclined, and are passed onto a vibrating surface 20 which is arranged below the screen 19 substantially in parallel therewith. When the vibrating screen 19 is chosen such that it has a sufficient length, all of the returns below a specific size will be separated from the briquettes 17 after having covered a certain distance. The vibrating surface 20 has a discharge end 21 which has provided underneath a downwardly extending returns chute 22. The returns chute 22 receives returns 6 and passes them onwards to a lower portion of a continuous conveyor 23 which immediately receives the returns 6 and conveys them upwards. The continuous conveyor 23 is preferably formed as a bucket elevator. At its upper end, the continuous conveyor 23 discharges the returns 6 to the conveyor pipe 5, so that the returns pass into the screw hopper 3 again. Depending on the duration of the operation of the return system, the temperature loss of the returns 6 will be relatively small. The whole return period from screen 19 to screw 7 is approximately only 30 seconds. This means that the existing temperature of the returns 6 is still at least 300° C. when these are filled into the screw hopper.

All of the compacted parts above the mesh size of the vibrating screen 19 will now be further transported by the slightly inclined vibrating screen 19 until they are filled into a briquette chute 24. The briquette chute 23 ends in a briquette cooler 25 which is designed as a vibration cooler which cools with a water bath 26. Water bath 26 ensures a rapid cooling of briquettes 17 and simultaneously prevents the reoxidation thereof in the hot state. A water inlet 27 is arranged on the briquette cooler 25 for supplying fresh water for the water bath 26 and a water outlet 28 is arranged for discharging water from the heated water bath 26. The cooling water is transported in a cooling circuit from the water outlet 28 via a heat exchanger 29 to the water inlet 27 and is passed within the briquette cooler 25 in counterflow fashion relative to the direction of transportation of the briquettes 17 through cooler 25. Briquettes 17 are cooled from about 700° C. to about 80° C. The discharge temperature of the briquettes 17 can be varied by controlling the water circulation amount and retention time of briquettes 17 in water bath 26. When the briquettes 17 are discharged at about 80° C. at a discharge location 30 of the briquette cooler 25, the residual heat of briquettes 17 is sufficient for drying the surface of briquettes 17. The vibration cooler 25 is preferably equipped with a controllable drive which permits the adjustment of the retention time of briquettes 17. Briquettes 17 then pass from the discharge location 30 to a briquette conveyor belt 31.

Sponge iron has a great tendency to reoxidation, especially in cases where the temperature thereof is still relatively high. During briquetting a certain amount of fines passes in unpressed form through roller press 8. As a consequence, all spaces around the roller press 8, the separating device, as well as the space around the continuous conveyor 23 must be kept in a low-oxygen state by all means. To this end, flushing with inert gas is preferably performed, or an inert gas atmosphere is established. The individual units are equipped with corresponding connections for inert gas. The screw hopper 3 and the briquette cooler 25 may each have a connection for inert gas. To this end, the units have substantially gastight housings (not shown). The temperature loss of the returns 6 can be reduced once more by providing a hot atmosphere of inert gas.

The relatively fine starting material is especially taken into account in the roll diameters and in the circumferential speed at which press rolls 9 and 10 can make briquettes. A roll diameter of about 1400 mm has turned out to be advantageous because of the poor feed of the fine ore 1. The circumferential speed is 0.36 m/s at the most, which corresponds to a speed of about 5 revolutions per minute. If fine ore 1 is to be processed with an especially small grain size, this makes it necessary to reduce the roll speed considerably. That is why in such systems the speed is controlled not only in accordance with the desired amount of discharge, but also in accordance with the briquetting capacity of the fine ore 1. This means that the finer the starting product is, the slower the rotation of the press rolls 9 and 10 has to be. This, however, means also that at an optimum grain size an increase in the throughput of the roller press 8 can be expected when the circumferential speeds are increased. Such an optimum grain size, however, can also be achieved by mixing a corresponding amount of returns 6 to the fine ore 1 which is per se too fine. It becomes apparent how great the influence can be that is exerted by the continuous returning of the returns 6 on the briquetting capacity of the fine ore 1. Furthermore, there are no local over-loads on the press rolls 9 during processing, since the particle size of the returns 6 does not exceed a specific value and the temperature of the returns 6 is still so high that a considerable decrease in the temperature of the mixed briquetting material does not take place.

Figure 2:
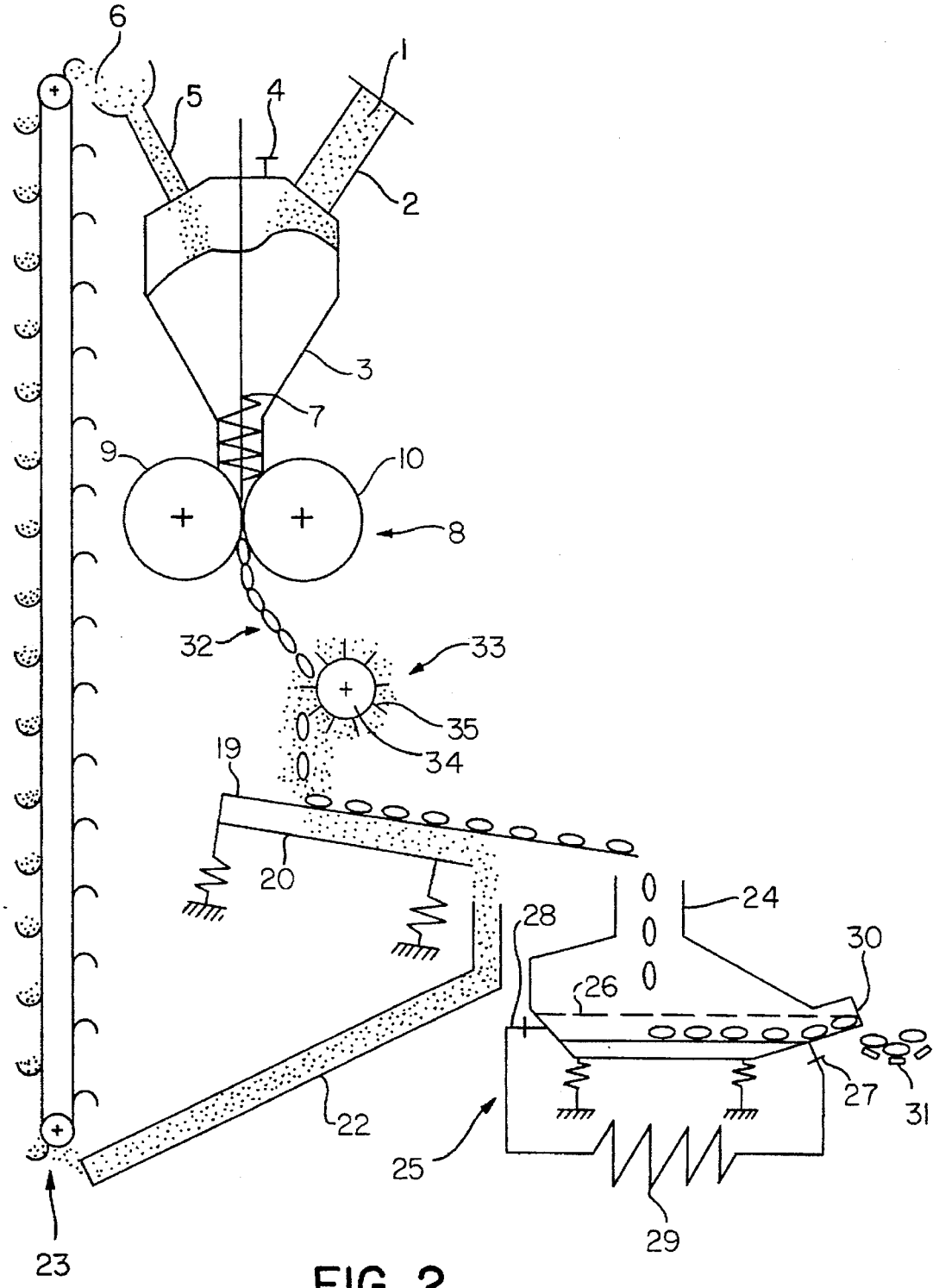
FIG. 2 is a diagrammatic view of a second embodiment of the present invention.
Figure 4:
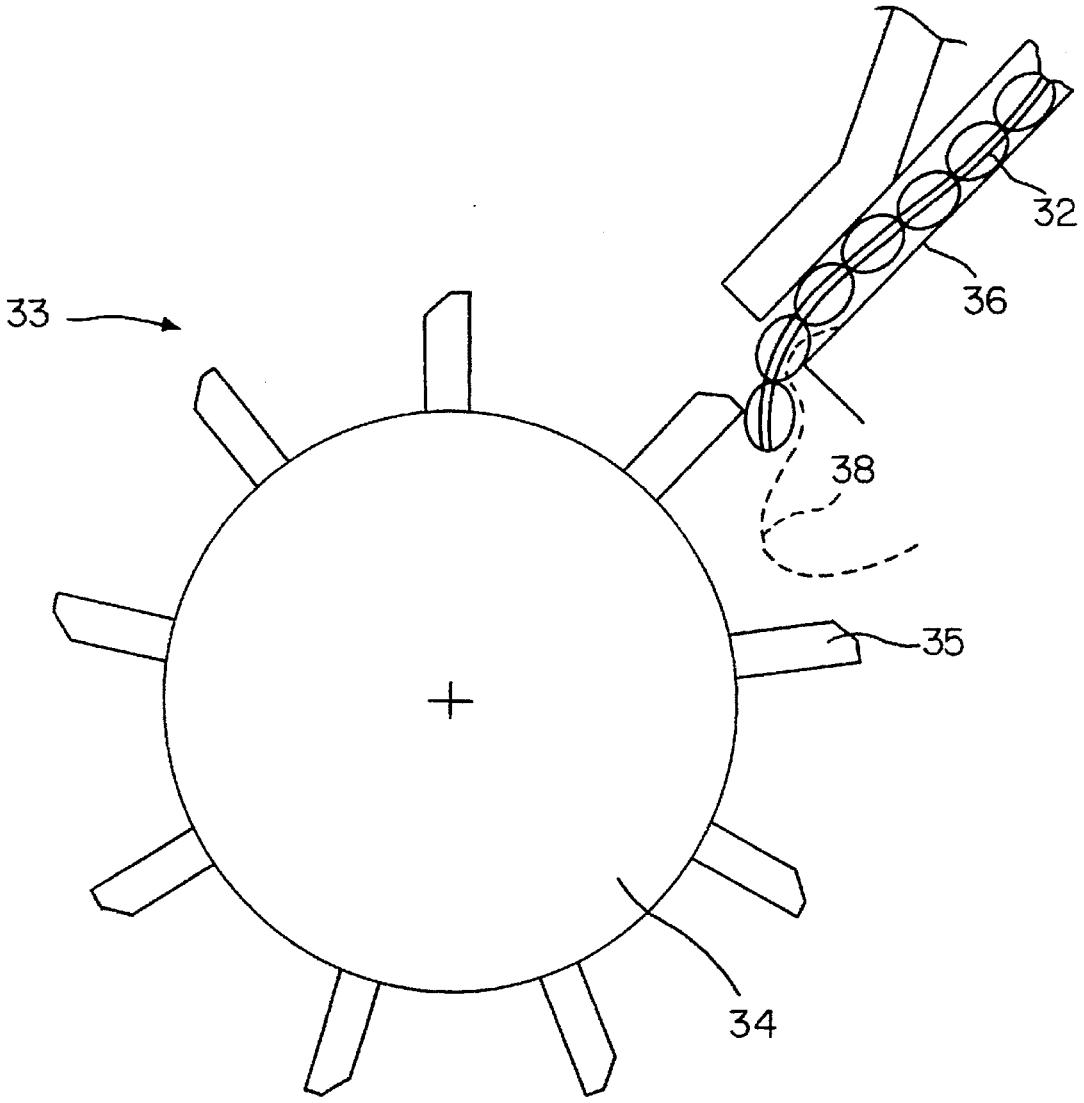
FIG. 4 is a diagrammatic view of a briquette strip divider.

A second embodiment of the present invention shall now be explained in more detail with reference to FIGS. 2–4. The following text will only deal with the differences as to the above method and apparatus. The same reference numerals are used for the same or similar components.

In the second embodiment of the present invention, press rolls 9 and 10 of roller press 8 are operated with a different control concept. Press roll 10 is here operated as a loose roll and press roll 9 as a fixed roll. To this end, the hydraulic pressure in the hydraulic cylinders 16 is chosen such that these are displaced accordingly at an increased pressure in the nip of press rolls 9 and 10. As a result, the loose roll 10 can adapt to the amount of material which is pressed by screw 7 into the nip. This process can clearly be recognized through the movement of the bearing housing 15 during operation of the roller press 8. The displacement of the bearing housing 15 serves as an indication of the size of the nip and thus of the seam thickness between the individual briquettes 17. In accordance with the movement of roll 10, the hydraulic pressure also changes accordingly, as well as the torque or power consumption of press rolls 9, 10 which can also be used as a controlled variable.

Fine ore can now also be briquetted thanks to the present invention by virtue of this control concept which has so far only been known in the case of lump ore and pellets. This is due to the fact that a fluidization of the briquetting material is prevented in the nip due to the purposeful coarsening of the briquetting material. A briquette strip 32 with fine ore 1 as the starting material can now be produced. The individual briquettes now adhere to each other at the briquette seams owing to the relatively big nip.

The briquette strip must subsequently be divided again by a separating device into individual briquettes 17 and returns 6. The separating device has associated therewith a briquette strip divider 33 which, as can especially be seen in FIG. 4, includes a rotor 34 which has radially projecting rotor blades 35 on its outer circumference. The circumferential speed of rotor 34 is adapted to the speed of the roller press 8, so that a briquette is respectively knocked off with a rotor blade 35. To this end, the briquette strip 32 is guided on a guide rail 36 above the free end of which a holding-down device 37 is provided for holding down the briquette strip 32 which vaults during the knocking-off operation. Since, as can be gathered from FIG. 3, the briquette strip 32 is also formed of two respectively adjacent briquettes 17, there is additionally provided a nose 38, which is drawn in broken line in FIG. 4. Nose 38 severs the center web of the briquette strip 32. To this end, rotor 34 is preferably formed accordingly.

The briquettes 17 are isolated by the striking process of the rotor 34, resulting in the formation of corresponding returns 6.

Above the roller press 8, and below the briquette strip divider 33, the system and the mode of operation thereof are the same as those described above.

Hence, the method of the invention still provides for the possibility of processing fine ore independently of the control concept of the roller press 8. This can especially be noticed in a positive manner in the last-described control concept in that the service life of the molding tools with the briquette pockets 11 can be considerably increased. As a result, the segment or ring costs in hot-briquetting systems for fine ore can be considerably reduced.

I claim:

1. A method for making sponge iron briquettes (17) from fine ore (1) with a maximum grain size of less than 2 mm, preferably less than 0.5 mm, wherein hot fine ore (1) is fed to a roller press (8) and is briquetted by opposite briquette pockets (11) of said roller press (8) to form sponge iron briquettes (17) and wherein during briquetting fine ore compacted between said briquette pockets (11) by one of the separating webs, and fines in dust form are produced, said materials being separated as returns (6) from said sponge iron briquettes (17) and fed to the hot fine ore (1) prior to briquetting, the mean grain size of fine ore (1) being smaller than the mean particle size of said returns (6), characterized in that said returns (6) are directly supplied to a conveyor system (23) after having been separated from said sponge iron briquettes (17) and said returns (6) which are still hot are fed by said conveyor system (23) substantially evenly and continuously to the hot fine ore to be still briquetted.

2. A method according to claim 1, characterized in that said sponge iron briquettes (17) and said returns fall into a vibration drum (18) or rotation drum after briquetting to separate returns (6) and sponge iron briquettes (17) substantially completely from one another.

3. A method according to claim 1, characterized in that said sponge iron briquettes (17) and said returns (6) are conveyed by said vibration drum (18) or rotation drum to a vibrating screen (19) which separates sponge iron briquettes (17) and returns (6) from one another.

4. A method according to claim 1, characterized in that fine ore (1) and returns (6) are supplied to a screw hopper (3) arranged above briquetting rolls (9, 10), whose screw (7) presses the mixed fine ore (1) and returns (6) into the nip of said briquetting rolls (9, 10).

5. A method according to claim 1, characterized in that said hot sponge iron briquettes (17) are fed to a briquette cooler (25) after having been separated from returns (6).

6. A method according to claim 1, characterized in that said sponge iron briquettes (17) are cooled in a water bath (26) in said briquette cooler (25).

7. A method according to claim 1, characterized in that said returns (6) which are separated by said screen (19) have a maximum grain size of about 15 mm.

8. A method according to claim 1, characterized in that said fine ore (1) and said returns (6) are pressed by said roller press (8) in such a manner tht sponge iron briquette strip pieces are at least obtained.

9. A method according to claim 1, characterized in that said briquette strip (32) is divided by a briquette strip divider (33) into individual sponge iron briquettes (17) and returns (6) and said sponge iron briquettes (17) and said returns (6) are subsequently conveyed to said vibrating screen (19).

10. A method according to claim 1, characterized in that prior to briquetting said fine ore (1) has a temperature of substantially 650° C. to 830° C.

11. A method according to claim 1, characterized in that said returns (6) have a temperature of substantially more than 300° C. when being supplied into said fine ore (1).

12. A method according to claim 1, characterized in that at least the briquetting operation, as well as separation and transportation of returns are substantially performed in an inert gas atmosphere.

13. A hot-briquetting system for sponge iron briquettes (17) made from fine ore (1), in particular according to a method according to claim 1, comprising a roller press (8) including a pair of rolls (9, 10) provided with molding pockets (11), a separating device arranged below said roller press (8) for separating sponge iron briquettes (17) and returns (6), and a conveyor system (23) for conveying said returns (6) from said separating device to a hopper (3) which is arranged above said roller press (8) and in which said returns (6) are mixed with said hot fine ore (1), characterized in that said conveyor system includes a continuous conveyor (23) for substantially continuously and evenly returning said returns (6) in their hot state.

14. A hot-briquetting system according to claim 13, characterized in that said hopper (3) has arranged thereon an upwardly directed downpipe (5) for feeding said returns (6), the upper end thereof being assigned to a continuous conveyor (23), preferably a bucket conveyor, which conveys said returns (6) upwards and discharges the same into said upper end.

15. A hot-briquetting system according to claim 13, characterized in that said hopper (3) is a screw hopper whose prepress screw (7) is substantially arranged at the lower end of said screw hopper (3) and above the nip of said pair of rolls (9, 10) for pressing mixed fine ore (1) and returns (6) into said nip.

16. A hot-briquetting system according to claim 13, characterized in that said pair of rolls (9, 10) includes a loose roll (10) and a fixed roll (9), said loose roll (10) adapting to the amount of material supplied and the thickness of the briquette seam being adjustable for preferably producing a briquette strip (32).

17. A hot-briquetting system according to claim 16, characterized in that a briquette strip divider (33) is arranged underneath said pair of rolls (9, 10) as part of said separating device for dividing said briquette strip (32) into individual briquettes (17) and returns (6).

18. A hot-briquetting system according to claim 13, characterized in that said pair of rolls (9, 10) has two rigid fixed rolls for producing briquettes (17) with a briquette seam of a relatively small thickness.

19. A hot-briquetting system according to claim 18, characterized in that a vibration drum (18) or rotation drum is arranged underneath said roller press (8) as part of said separating device for separating briquettes (17) and returns (6) from one another, said briquettes (17) and said returns (6) falling thereinto after the briquetting operation.

20. A hot-briquetting system according to claim 19, characterized in that the axis of said vibration drum (18) or rotation drum is slightly inclined relative to the horizontal for conveying briquettes (17) and returns (6) in the direction of inclination.

21. A hot-briquetting system according to claim 13, characterized in that said separating device has assigned thereto a screen (19) for separating briquettes (17) and returns (6), said screen having preferably a mesh width of from 8 mm to 15 mm.

22. A hot-briquetting system according to claim 21, characterized in that said screen (19) is formed as a slightly inclined vibrating screen which conveys said sponge iron briquettes (17) into a briquette chute (24) which extends from a discharge end (21) of said screen (19) downwards.

23. A hot-briquetting system according to claim 21, characterized in that a vibrating surface (20) is arranged underneath said screen (19) for receiving and directly transporting said returns (6), said vibrating surface (20) conveying said returns (6) into a returns chute (22) which extends from a discharge end (21) of said vibrating surface (20) downwards and which is assigned at its lower end to a lower portion of said continuous conveyor (23) for discharging said returns (6).

24. A hot-briquetting system according to claim 14, characterized in that said lower end of said briquette chute (24) ends in a briquette cooler (25).

25. A hot-briquetting system according to claim 13, characterized in that said briquette cooler (25) is designed as a vibration cooler which cools with a water bath (26) and which has a water inlet (27), a water outlet (28) and a discharge location (30) for said briquettes (17).

26. A hot-briquetting system according to claim 25, characterized in that said briquette cooler (25) has assigned thereto a heat exchanger (29) which is connected to said water inlet (27) and said water outlet (28) for recooling the cooling water.

27. A hot-briquetting system according to claim 13, characterized in that said roller press (8), said separating device, said briquette cooler (25) and said conveyor system (23) are surrounded by a substantially gastight housing which has at least one gas connection for introducing preferably inert gases.

28. A hot-briquetting system according to claim 13, characterized in that said hopper (3) has a connection for introducing inert gases, as well as a ventilating valve (4).

* * * * *